US007111394B2

(12) United States Patent
Wert

(10) Patent No.: US 7,111,394 B2
(45) Date of Patent: Sep. 26, 2006

(54) HYBRID LOOP HEAT PIPE

(75) Inventor: Kevin L. Wert, Halifax, PA (US)

(73) Assignee: Thermal Corp., Wilmington, DE (US)

( * ) Notice: Subject to any disclaimer, the term of this patent is extended or adjusted under 35 U.S.C. 154(b) by 0 days.

(21) Appl. No.: 10/987,893

(22) Filed: Nov. 12, 2004

(65) Prior Publication Data

US 2005/0086806 A1 Apr. 28, 2005

Related U.S. Application Data

(63) Continuation of application No. 10/690,906, filed on Oct. 22, 2003, now Pat. No. 6,926,072.

(51) Int. Cl.
*B23P 6/00* (2006.01)

(52) U.S. Cl. ..... 29/890.032; 29/890.036

(58) Field of Classification Search ..... 29/890.06, 29/890.07, 890.032, 890.036, 890.054; 165/104.21, 165/104.26; 257/705–707, 712–722; 361/687, 361/695, 719
See application file for complete search history.

(56) References Cited

U.S. PATENT DOCUMENTS

| | | | | |
|---|---|---|---|---|
| 3,490,718 | A | 1/1970 | Vary | 244/171.8 |
| 3,587,725 | A * | 6/1971 | Basiulis | 165/104.26 |
| 3,613,773 | A | 10/1971 | Hall et al. | 165/273 |
| 3,741,289 | A | 6/1973 | Moore | 165/272 |
| 3,963,010 | A | 6/1976 | Harned | 165/104.26 |
| 4,474,170 | A | 10/1984 | McConnell et al. | 118/317 |
| 4,917,177 | A * | 4/1990 | Gernert | 165/104.26 |
| 5,103,897 | A | 4/1992 | Cullimore et al. | 165/104.26 |
| 5,320,866 | A | 6/1994 | Leonard | 427/205 |
| 5,705,118 | A | 1/1998 | Hayes et al. | 264/414 |
| 5,725,049 | A | 3/1998 | Swanson et al. | 122/366 |
| 6,058,711 | A | 5/2000 | Maciaszek et al. | 165/104.26 |
| 6,076,595 | A | 6/2000 | Austin et al. | 165/104.33 |
| 6,239,350 | B1 | 5/2001 | Sievers et al. | 429/104 |
| 6,341,491 | B1 | 1/2002 | Paine et al. | 62/380 |
| 6,382,309 | B1 | 5/2002 | Kroliczek et al. | 174/15.2 |
| 6,437,982 | B1 | 8/2002 | Cardenas | 165/104.33 |
| 6,585,509 | B1 | 7/2003 | Young et al. | 431/208 |
| 6,698,502 | B1 | 3/2004 | Lee | 165/135 |
| 6,926,072 | B1 * | 8/2005 | Wert | 165/104.26 |
| 2002/0062648 | A1 | 5/2002 | Ghoshal | 165/104.26 |

* cited by examiner

*Primary Examiner*—Peter Vo
*Assistant Examiner*—Hung C. Le
(74) *Attorney, Agent, or Firm*—Duane Morris LLP

(57) ABSTRACT

A heat pipe assembly (100) has a combined reservoir (102) and evaporator (104), the evaporator (104) having ducts of a vapor manifold (106) that exhausts vapor toward the condenser (108) instead of opposing the flow of liquid condensate to the reservoir (102), and the evaporator (104) having a wick passage that impels the condensate toward the reservoir (102) instead of opposing the flow of vapor.

6 Claims, 4 Drawing Sheets

HYBRID LOOP HEAT PIPE

This application is a continuation application of U.S. application Ser. No. 10/690,906, filed on Oct. 22, 2003, now U.S. Pat. No. 6,926,072.

FIELD OF THE INVENTION

The invention relates to the field of heat pipes, and more particularly relates to a hybrid heat pipe that combines a heat pipe with a supplementary cooling device.

BACKGROUND

U.S. Pat. No. 6,382,309 discloses a heat pipe assembly having an evaporator for vapor in a first casing, and a reservoir for condensate in a second casing. In addition to the space consumed by two casings, both casings are open one-to the-other and need to be hermetically sealed to support an evacuated internal environment. Combining the evaporator and reservoir would face the difficulty of combining vapor and condensate in the same casing, which would tend to cause thermal interaction of vapor and liquid. The heat transfer efficiency of the heat pipe would be reduced. Further, the flow loop of the heat pipe would be slowed by reduced vapor pressure and reduced liquid flow. Further, a combined evaporator and reservoir in the same casing would contribute further parasitic heating of the reservoir due to the industry known, heat leak problem associated with a loop heat pipe.

SUMMARY OF THE INVENTION

A heat pipe assembly according to the invention combines a reservoir and an evaporator in the same casing. The vapor flow is desirably toward a condenser of the heat pipe. The liquid flow is enhanced by capillary activity. Thus, the invention avoids slow down, or opposition to, the flow loop of the heat pipe.

According to a separate embodiment of the invention, the invention provides supplemental cooling of the reservoir, which offsets parasitic heating of the reservoir due to the industry known, heat leak problem associated with a loop heat pipe.

DETAILED DESCRIPTION

Figure 1:
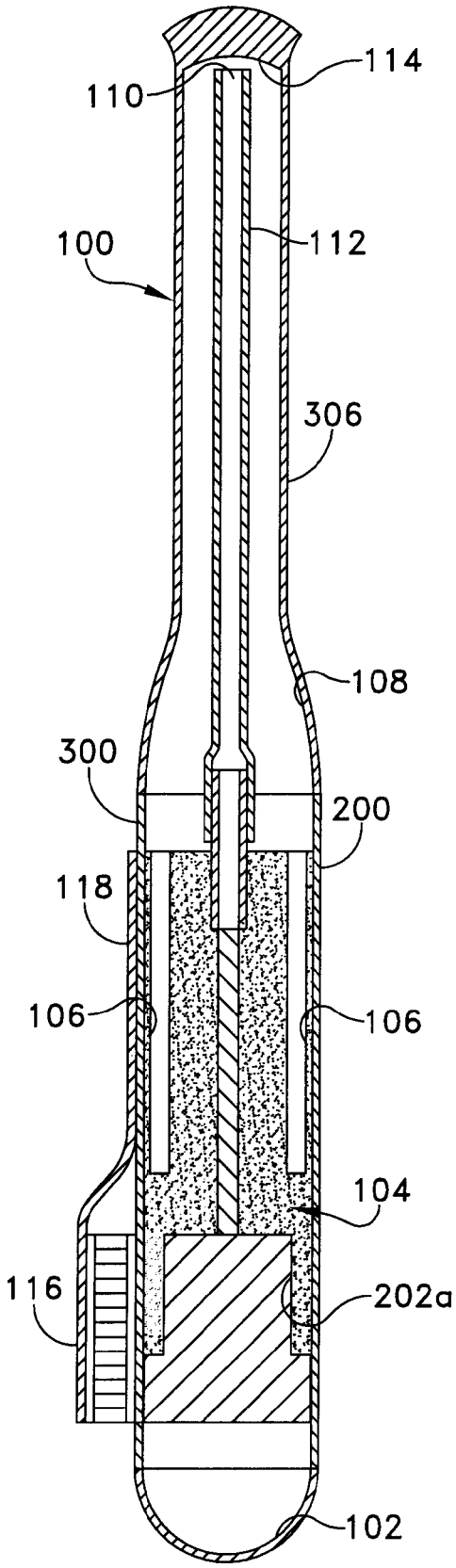
FIG. 1 is a side view in section of a heat pipe assembly according to the invention.

This description of the exemplary embodiments is intended to be read in connection with the accompanying drawings, which are to be considered part of the entire written description. In the description, relative terms such as "lower," "upper," "horizontal, " "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

FIG. 1 discloses a heat pipe assembly (100). The interior of the heat pipe assembly (100) is a sealed envelope that has been evacuated, and a quantity of working fluid added. The heat pipe assembly (100) has a reservoir (102) supplying liquid phase working fluid to an evaporator (104) wherein heat exchange occurs to change the working fluid to vapor. The vapor collects in a vapor manifold (106) that transports the vapor under increased vapor pressure to a condenser (108). In the condenser (108), latent heat is recovered from the vapor to form condensate. The latent heat is expelled by heat transfer to the environment. The condensate collects in an open inlet (110) of a liquid condensate artery (112) that returns the condensate in liquid state to the reservoir (102) where the liquid accumulates.

Figure 2:
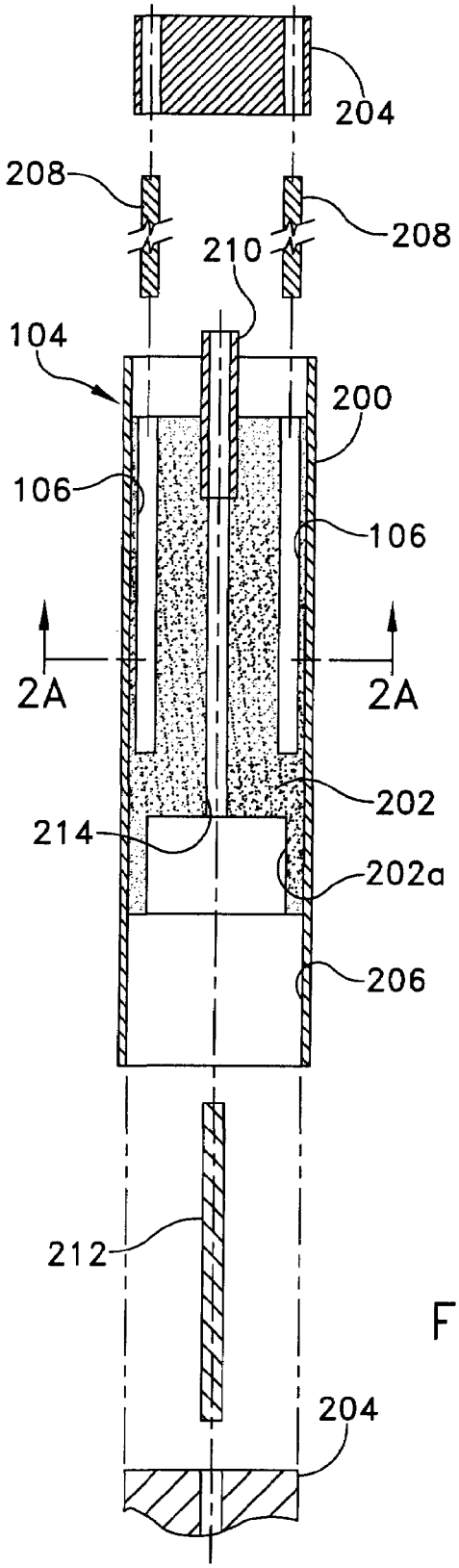
FIG. 2 is a side view in section of an evaporator section of the assembly disclosed by FIG. 1.
Figure 2A:
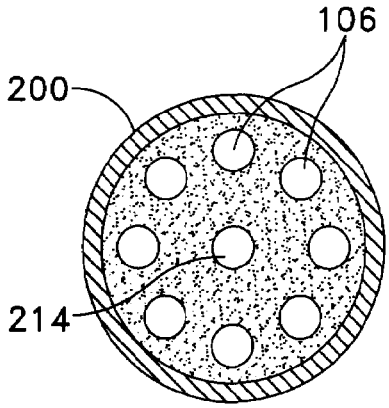
FIG. 2A is a cross section taken along the line 2A—2A of FIG. 2.

FIG. 2 discloses the evaporator (104) as an assembly having a metal tube (200), and an evaporator wick (202) that is sintered in situ. The wick (202) is a porous body, and wicks liquid phase working fluid. The liquid absorbs latent heat, and converts to vapor in the evaporator (104). The wick (202) is fabricated of particles of a sintering material that are, first, compacted in the tube by forming-dies (204), followed by heating the surface molecules of the compacted particles to a fluent state. The particles are cooled to solidify and fuse to one another to form the sintered, porous evaporator wick (202). The wick (202) fuses to the interior surface of the metal tube (200), which secures the wick (202) to the tube (200). The sintering material is partially solidified before the particles completely fuse, when the particles partially solidify and are self-supporting. FIG. 2 discloses that the forming dies (204) are withdrawn from the partially solidified sintering material. Further details of a porous wick are disclosed by U.S. Pat. No. 6,382,309.

The wick (202) has an end surface (202*a*) that is substantially recessed within a corresponding end of the tube (200), which forms a hollow reservoir section (206) that is bounded by the wick (202) and by the encircling tube (200). One of the forming-dies (204) enters the open end of the tube (200) and recesses the compacted sintering material.

FIG. 2 discloses multiple core pins (208) that have been withdrawn from the partially solidified sintering material to form interior ducts of the vapor manifold (106) that receive vapor that percolates through the porous wick (202). The ducts of the manifold (106) exhausts vapor to the condenser (108) through an end of the wick (202) facing the condenser (108). Vapor that forms in the sintered material, collects in the ducts and is driven by an increase in vapor pressure toward the condenser (108), instead of opposing the flow of liquid condensate to the reservoir (102) and contributing to parasitic heating of the reservoir (102).

FIG. 2 discloses a short length of hollow metal pipe (210) imbedded in the in situ sintered wick (202). During sintering, the pipe (210) is held in position by a core pin (212) that protrudes from one of the forming-dies (204). The core pin (212) is withdrawn, leaving the pipe (210) imbedded in the sintered material. FIG. 2 discloses the core pin (212) as withdrawn from the partially solidified sintering material. The core pin (212) forms a hollow wick passage (214) that extends from the pipe (210), through the wick (202) and into the reservoir section (206). Thus, the wick passage (214) and the pipe (21) become parts of the artery (112) such that, working fluid returns as condensate in liquid state along the liquid condensate artery (112) from the condenser (108), toward the reservoir (102), where the liquid accumulates. Wicking activity by the wick (202) draws liquid phase working fluid from the wick passage (214). The reservoir (102) supplements the wick (202 ) with additional liquid. The liquid flow by the wicking activity is toward the vapor manifold (106), instead of, opposing the flow of vapor to the condenser (108) and contributing to parasitic heating of the reservoir (102).

As disclosed by FIG. 1, the liquid or condensate artery (112) is a tube that is coupled onto the protruding pipe (210). A fluid tight coupling is desired, which can be formed by an interference fit of the pipe (210) in the artery (112). An hermetic seal is not required, since the liquid condensate artery (112) is not an exterior pressure boundary. According to an embodiment of the invention, the liquid condensate artery (112) is advantageously fluid phobic to avoid wetting by the condensate. According to another embodiment of the invention, the liquid condensate artery (112) is advantageously a heat insulating material to limit thermal interaction between condensate in the liquid condensate artery (112) and any vapor that might be present near the liquid condensate artery (112). For example, the material polytetrafluroethylene satisfies the requirements of both embodiments of the liquid condensate artery (112).

Figure 3:
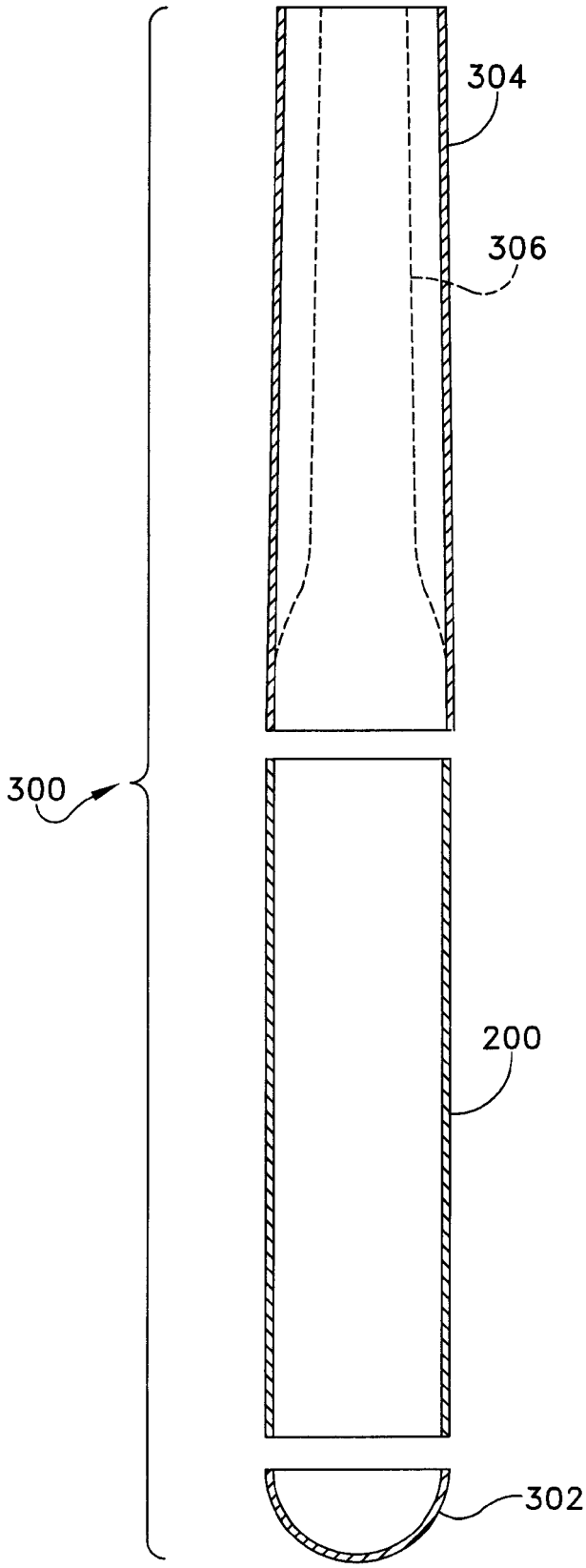
FIG. 3 is a side view in section of outer tube sections.

FIG. 3 discloses an outer tube (300) of the heat pipe assembly (100). An end section (302) of the tube (300) joins the tubular evaporator section (200), for example, by welding or brazing to form the evaporator section (200) with a closed end. As disclosed by FIG. 1, the tube (200) of the evaporator (104) forms a casing for the reservoir (102) and the wick (202), which eliminates a need for a knife edge, liquid tight, seal. Further, the wick (202) extends into the reservoir (102) and combines the primary and secondary functions of a loop heat pipe by having a sintered body of a combined wick (202) and reservoir (102) in the same casing. The sintered wick (202) forms one end of a casing containing the reservoir (102) and the accumulated liquid phase working fluid. A secondary wick (202*a*) is formed as a hollow cylindrical extension, or annular extension of the sintered wick (202). The secondary wick (202*a*) is unitary with the remainder of the sintered wick (202), and is formed simultaneously with the remainder of the sintered wick (202). The secondary wick (202*a*) is against the tube (300). The secondary wick (202*a*) is secured by bonding with the tube (300). When the heat pipe assembly (100) is in an orientation that the liquid in the reservoir (102) tends to drain away from the sintered wick (202), the secondary wick (202*a*) extends deeply into the reservoir (102) and remains in communication with the liquid to wick the liquid. Further, the secondary wick (102*a*) communicates with the remainder of the wick (202), and wicks the liquid into the wick (202).

FIG. 3 discloses a tubular condenser section (304) of the outer tube (300). The condenser section (304) is disclosed as a separate section that is joined to the evaporator section tube (200) by brazing or welding. As an alternative embodiment of the invention, the condenser section (304) is integral with the evaporator section tube (200). The condenser section (304) is disclosed as having a relatively large diameter. Alternatively, the condenser section (304) is swaged to a smaller diameter condenser section (306), as shown in dotted outline in FIG. 3. FIG. 1 discloses an embodiment of the present invention having the smaller diameter condenser section (306).

As shown in FIG. 1, the condensate artery (112) extends within the condenser section (108) of the outer tube (300). The end (114) of the condenser section (108) is initially open, and provides a site for evacuating the envelope formed by the outer tube (300), and for back filling the inlet (110) of the artery (112) with a quantity of working fluid. The end (114) of the condenser section (306) is then closed off, including, but not limited to having; a brazed or welded end section, or having a pinch-off to form a seam that is shut by cold weld or sealed shut by a sealant.

Vapor is transported in an annular space between the artery (112) and the outer tube (300) of the condenser (108). Condensate migrates to an open inlet (110) of the artery (112). The evaporator section has been swaged to a smaller diameter section (306), which sizes the annular space in which condensate forms as webs of condensate and agglomerate slugs of condensate that wet the artery (112) and the outer tube (300), and bridge across the annular space. The vapor pressure drives the webs and slugs toward the inlet (110) of the artery (112). Alternatively, the evaporator section (304) of the outer tube (300) has a larger diameter, as disclosed by FIG. 3, that does not rely on formation of webs and slugs, and is particularly for applications relying on gravity to drive the condensate toward the inlet (110).

FIG. 1 discloses another embodiment of the invention having a thermo-electric cooler (116) attached against the conducting exterior surface of the reservoir (102), and having a thermally conducting strap (118) attached against the evaporator section (304). The thermo-electric cooler (116) is of known construction, and supplies supplemental cooling of the liquid accumulated in the reservoir (102), and heat transfer to the evaporator section (304) and the vapor therein. Supplemental cooling offsets parasitic heating of the reservoir (102) due to the industry known, heat leak problem associated with a loop heat pipe.

Figure 4:
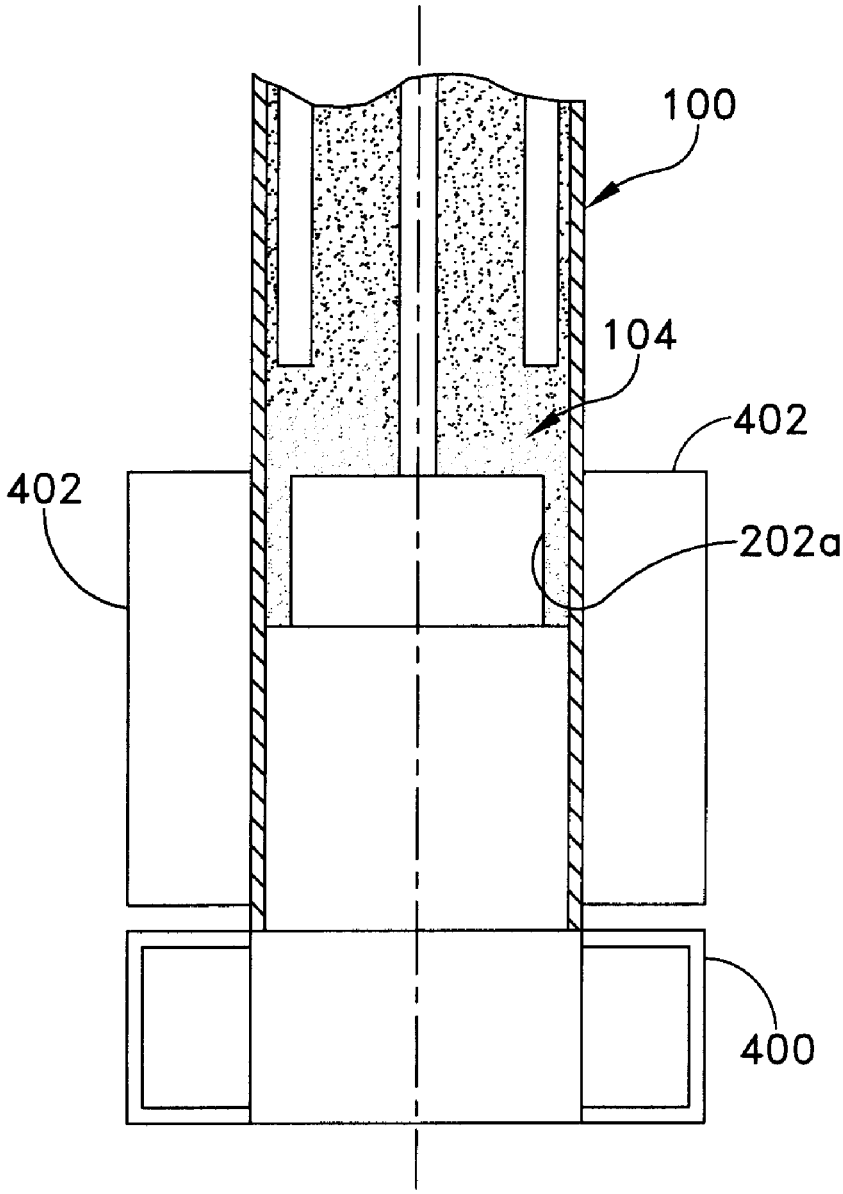
FIG. 4 is a fragmentary view of a heat pipe assembly and a cooling fan.

FIG. 4 discloses another embodiment of the invention having an axial fan (400). The heat pipe assembly (100) is lengthwise in the downstream path of the air flow that is impelled by the axial fan (400), with the reservoir (102) closest to the axial fan (400). The heat pipe assembly (100) is encircled by an axial air flow, that passes over broad surfaces of thin fins (402) that are heat conductive. The fins (402) are conductively attached, for example, by welding or brazing, to the exterior surface of the reservoir (102). The axial air flow removes heat that has been transferred from the liquid in the reservoir (102) to the fins (402), which cools the liquid substantially below its temperature of condensation. The axial air flow passes over the exterior surfaces of the evaporator section (304) and the condenser section (306) to remove heat that has been transferred from the vapor phase working fluid in the condenser (108).

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

The invention claimed is:

1. A method of making a heat pipe assembly, comprising the steps of:

making a combined reservoir and evaporator wick;

connecting a liquid return artery and a liquid return passage extending through the evaporator wick;

surrounding the artery and the combined reservoir and evaporator wick with an outer tube having a condenser; and sealing the outer tube after evacuating the outer tube and back filling the liquid return artery with a quantity of working fluid.

2. The method of claim 1, and further comprising the steps of:

forming a wick extension of the evaporator wick; and extending the wick extension into the reservoir.

3. The method of claim 1, and further comprising the step of:

forming a vapor manifold in the wick; the vapor manifold communicating with the condenser.

4. The method of claim 1 wherein, the step of making a combined reservoir and evaporator wick, further comprises the step of; sintering the evaporator wick in situ within an external tube section of the heat pipe assembly, while forming an end of the reservoir with the evaporator wick.

5. The method of claim 4, and further comprising the step of: forming a vapor manifold in the wick, the vapor manifold communicating with the condenser.

6. The method of claim 4, and further comprising the steps of:

forming a wick extension of the evaporator wick; and extending the wick extension into the reservoir.

* * * * *